United States Patent [19]

Yoshida et al.

[11] Patent Number: 4,592,991

[45] Date of Patent: Jun. 3, 1986

[54] SILVER HALIDE PHOTOGRAPHIC PRINTING PAPER

[75] Inventors: Tetsuo Yoshida; Tadayoshi Kokubo; Keiichi Adachi; Tadashi Ikeda; Hidetoshi Kobayashi, all of Kanagawa, Japan

[73] Assignee: Fuji Photo Film Co., Ltd., Kanagawa, Japan

[21] Appl. No.: 684,402

[22] Filed: Dec. 20, 1984

[30] Foreign Application Priority Data

Dec. 22, 1983 [JP] Japan ..... 58-242717

[51] Int. Cl.[4] ..... G03C 5/16; G03C 7/26; G03C 1/02

[52] U.S. Cl. ..... 430/139; 430/546; 430/566; 430/933

[58] Field of Search ..... 430/933, 139, 546, 566

[56] References Cited

U.S. PATENT DOCUMENTS

| | | | |
|---|---|---|---|
| 3,726,684 | 4/1973 | Riester et al. | 430/933 |
| 3,801,323 | 4/1974 | Arai et al. | 430/566 |
| 4,193,802 | 3/1980 | Mukunoki et al. | 430/566 |
| 4,275,145 | 6/1981 | Mikami et al. | 430/546 |
| 4,419,433 | 12/1983 | Kubbota et al. | 430/566 |

FOREIGN PATENT DOCUMENTS

| | | | |
|---|---|---|---|
| 81836 | 7/1981 | Japan | 430/569 |

*Primary Examiner*—Mary F. Downey

*Attorney, Agent, or Firm*—Sughrue, Mion, Zinn, Macpeak & Seas

[57] ABSTRACT

A silver halide photographic printing paper is described, comprising a support and a photographic layer containing a silver halide developing agent, wherein a dispersion of an oil-soluble brightening agent in a high boiling point organic solvent having a specific inductive capacity of 7.5 or less is contained in the photographic layer. This printing paper yields a background of high whiteness even when processed under rapid processing conditions.

13 Claims, No Drawings

SILVER HALIDE PHOTOGRAPHIC PRINTING PAPER

FIELD OF THE INVENTION

The present invention relates to a silver halide photographic printing paper. More particularly, it is concerned with a silver halide photographic printing paper containing a silver halide developing agent and capable of producing a background of high whiteness even under rapid processing conditions.

BACKGROUND OF THE INVENTION

Incorporation of black and white developing agents such as hydroquinones, aminophenols, and phenidones, or color developing agents such as p-phenylenediamine derivatives, in a light-sensitive material has been widely employed so that satisfactory development can be attained even under very rapid developing conditions. (e.g., 30 seconds or less) It is also known that brightening agents can be applied to a silver halide photographic printing paper in order to increase the whiteness of the background of the paper after rapid processing. Particularly in rapid processing, in which the processing time is short, residual color resulting from sensitizing dyes and dyestuffs, for example, is liable to develop. Under such conditions, therefore, increasing whiteness is a significant requirement for providing a printing paper having a good appearance.

Brightening methods are, of course, generally applicable to increase whiteness irrespective of the presence of residual color.

The following brightening methods have heretofore been known: adding brightening agents to a paper support or a polyethylene layer laminated on the support; adding water-soluble or oil-soluble brightening agents to a silver halide emulsion layer or other photographic layers; and using a developer in which brightening agents have been incorporated.

In the case of a polyethylene-laminated paper, for example, which is suitable for rapid processing, if a brightening agent is incorporated into the polyethylene layer, it is readily decomposed during melt extrusion process of the polyethylene layer because of its poor heat stability. If a brightening agent is attempted to be added during development, no uniform finishing can be attained unless the concentration of the brightening agent is always maintained at a constant level. Thus, it is most preferred to incorporate brightening agents in photographic layers. In this method, oil-soluble brightening agents are effectively incorporated rather than water-soluble ones because the former do not elute out of the photographic layer during developing. For this purpose, British Pat. No. 1,072,915, for example, discloses a method in which water-soluble brightening agents are dissolved in organic solvents and then added to a gelatin layer in the form of dispersions. As these organic solvents, tributhyl phosphate and diethyl phthalate, for example, are used. It is also known that amide compounds as described in U.S. Pat. No. 2,322,027, for example, are suitable as organic solvents for use in emulsification of brightening agents.

In the case of light-sensitive materials containing developing agents in the photographic layer thereof for the purpose of rapid development, for example, it has been discovered that even if brightening agents are dissolved in such organic solvents and applied in the form of dispersions, satisfactory whiteness cannot be obtained, although the reason for this is not clear. When, on the other hand, water-soluble brightening agents as described in Japanese Patent Publication No. 30495/73, for example, are added to the photographic layer, the above phenomenon that the whiteness-increaseing effect is reduced by the presence of developing agents does not occur. Instead, other disadvantages are encountered in this case, for example, since the brightening agents, as described above, elute out during development, whiteness cannot be increased to an extent that is expected, and the whiteness varies depending on processing conditions.

SUMMARY OF THE INVENTION

An object of the present invention is to provide a silver halide photographic printing paper which is suitable for rapid development through incorporation of developing agents into a photographic layer and, irrespective of the presence of such residual color, has improved whiteness.

Another object of the present invention is to provide a silver halide photographic printing paper which always provides a constant high black or other color density and a background of high whiteness under any developing conditions.

It has been found that the above objects are attained by adding emulsified dispersions of oil-soluble brightening agents in high boiling point organic solvents having a specific inductive capacity of 7.5 or less to a photographic layer of a silver halide photographic printing paper containing developing agents.

The present invention relates to a silver halide photographic printing paper comprising a support and a photographic layer on the support, containing a silver halide developing agent, wherein an emulsified dispersion of an oil-soluble brightening agent in a high boiling point organic solvent having a specific inductive capacity of 7.5 or less is contained to the photographic layer.

DETAILED DESCRIPTION OF THE INVENTION

The term "photographic layer" used herein means an element comprising hydrophilic colloidal layers such as a photographic emulsion layer, a protective layer, an antihalation layer and an interlayer.

In silver halide photographic printing papers containing developing agents, the relationship between the specific inductive capacity of high boiling point organic solvents for use in emulsification or dispersion of oil-soluble brightening agents and the whiteness of a background of the paper after development has not been heretofore suspected while various high boiling point organic solvents such as dibutyl phtlalate and cresyl phosphate have been known in the art. It has now been found that whiteness greatly varies depending on the type of high boiling point organic solvents used in preparation of brightening agent dispersions. That is, if high boiling point organic solvents having a high specific inductive capacity are used, the brightening effect seriously drops, whereas if high boiling point organic solvents having a specific inductive capacity not exceeding a certain value are used, the brightening effect is great and satisfactory whiteness is obtained (about 90% or more according to the measurement of whiteness in Example 1). It has been found that this critical value is 7.5. Thus, if oil-soluble brightening agent dispersions prepared using high boiling point organic solvents having a specific inductive capacity of 7.5 or less, preferably 6.0 or less are added to a photographic layer containing developing agents, a silver halide photographic printing paper can be prepared conveniently which is suitable for rapid development and provides a finished background of improved whiteness. It is preferred that the specific inductive capacity of the solvent be 2.0 or more.

The specific inductive capacity can be easily determined by one skilled in the art. More specifically, it can be measured by the method described in *Sin Jikken Kagaku Koza* edited by Nippon Kagaku Kai published by Maruzen Co., Ltd., Vol. 5, Chapter 4, for example. In this method, the specific inductive capacity can be measured at 25° C. by the use of a specific inductive capacity-measuring apparatus (Model TRS-10T, produced by Ando Denki Co., Ltd.) according to the transformer bridge method (10 KHz).

Oil-soluble brightening agents can be added by the same procedure as is commonly used in the incorporation of oil-soluble couplers and oil-soluble ultraviolet absorbers, for example. That is, an oil-soluble brightening agent is dissolved in the high boiling point organic solvent of the present invention, if necessary, further containing a low boiling point solvent as an emulsifying aid or solubilizing agent which is easily mixed with water, mixed with an aqueous gelatin solution containing a surface active agent, emulsified or dispersed by the use of an emulsifying apparatus such as a colloid mill, a homogenizer, or an ultrasonic dispersion apparatus, and then added in the form of an emulsified dispersion. The droplet size in the dispersion is generally 0.3 μm or less, preferably 0.2 μm or less. High boiling point solvents which can be used for this purpose are those having a boiling point of 150° C. or higher, preferably 200° C. or higher and include carboxylic acid esters (e.g., phthalates, adipates, benzoates, laurates, sebacates etc.), phosphoric acid esters (e.g., tricresyl phosphate, tributhyl phosphate, etc.), carboxylic acid amides (e.g., N, N-diethyl caprlic amide, N,N-dimethyl palmitic amide, etc.), and substituted hydrocarbons (e.g., chloroparaffin, etc.). Further, low boiling point solvents are those having a boiling point of lower than 150° C., preferably 100° C. or lower and include ethyl acetate, buthyl acetate, cyclohexane, tetrahydrofuran, dimethylformamide, benzene, chloroform, acetone, methyl ethyl ketone, diethyl sulfoxide, methylcellosolve, etc.

Representative examples of high boiling point organic solvents having a specific inductive capacity of 7.5 or less which can be used in the present invention are shown in Table 1 along with their specific inductive capacities. It is to be noted, however, that the present invention is not limited thereto. For comparison, high boiling organic solvents having a specific inductive capacity of more than 7.5, which are unsuitable for use in the present invention, are also shown along with their specific inductive capacities.

TABLE 1

1-a

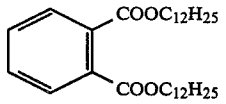

(4.17)

TABLE 1-continued 1-b

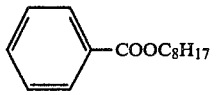

(4.41)

1-c

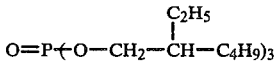

1-d

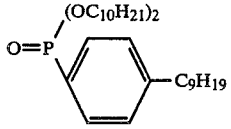

1-e

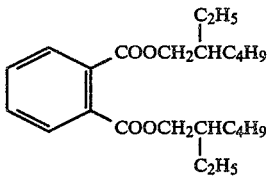

1-f

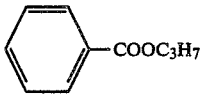

(5.78)

1-g

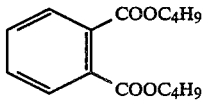

(6.45)

1-h

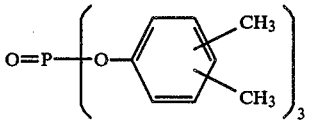

(6.74)

1-i

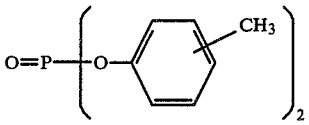

(7.35)

2-a (Comparative Example)

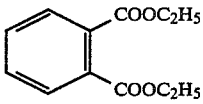

(7.53)

2-b (Comparative Example)

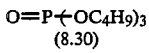

(8.30)

2-c (Comparative Example)

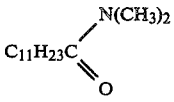

(13.45)

The ratio (by weight) of the emulsifying oil (i.e., high boiling point organic solvent) to the brightening is determined most appropriately taking into consideration the solubility of the brightening agent and self quenching, and it is henerally from 100/0.1 to 100/50 and preferably from 100/1 to 100/30.

The oil-soluble brightening agents used in the present invention are those substantially water-insoluble and include substituted stilbenes and substituted cumarines as described in British Pat. No. 786,234, and substituted thiophenes as described in U.S. Pat. No. 3,135,762, for example, are useful. In particular, brightening agents as described in Japanese Patent Publication No. 37376/70 and Japanese Patent Application (OPI) No. 126732/75 (the term "OPI" as used herein means a "published unexamined Japanese patent application") can be used advantageously.

Typical examples of such useful brightening agents are shown below.

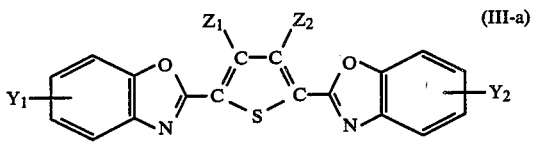

(III-a)

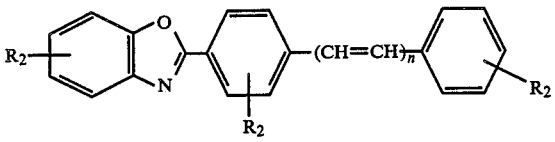

(III-b)

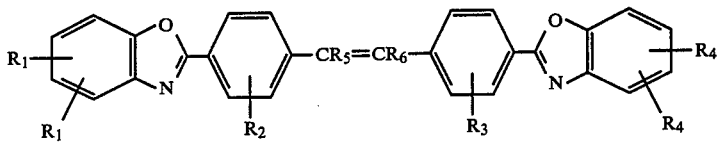

(III-c)

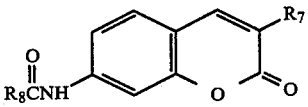

(III-d)

In the above general formulae:

$Y_1$ and $Y_2$ are each an alkyl group, $Z_1$ and $Z_2$ are each a hydrogen atom or an alkyl group, n is 1 or 2, $R_1$, $R_2$, $R_3$ and $R_4$ are each an aryl group, an alkyl group, an alkoxyl group, an aryloxyl group, a hydroxyl group, an amino group, a cyano group, a carboxyl group, an amido group, an ester group, an alkylcarbonyl group, an alkylsulfonyl group, a dialkylsufonyl group, or a hydrogen atom, $R_5$ and $R_6$ are each a hydrogen atom, a alkyl group, such as a methyl group and an ethyl group, or a cyano group, $R_7$ is a phenyl group, or a halogen or alkyl-substituted phenyl group, and $R_8$ is an amino group, or an organic primary or secondary amine.

The groups for $Y_1$, $Y_2$, $Z_1$, $Z_2$, $R_1$, $R_2$, $R_3$, $R_4$, $R_5$, $R_6$, $R_7$, and $R_8$ generally have 1 to 15 carbon atoms.

More specifically, the following brightening agents can be used.

III-1

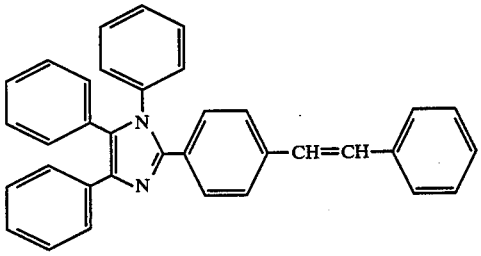

III-2

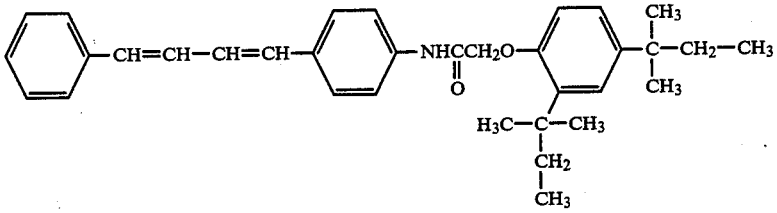

III-3

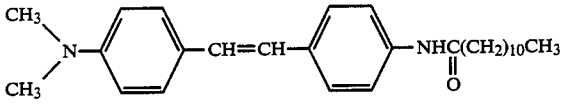

III-4

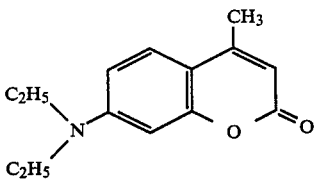

-continued
III-5
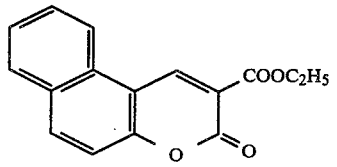
III-6
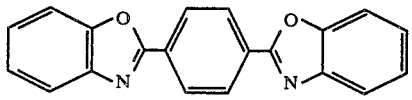
III-7
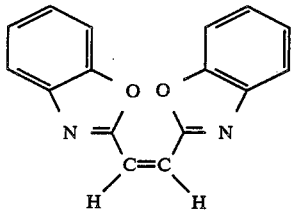
III-8
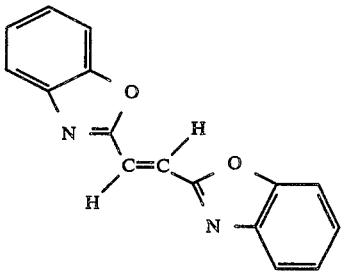
III-9
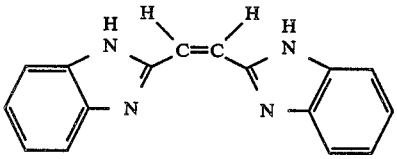
III-10
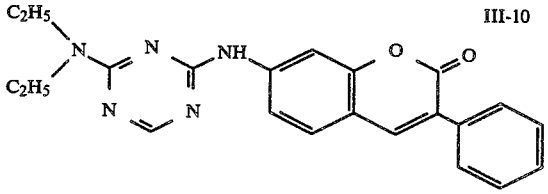
III-11
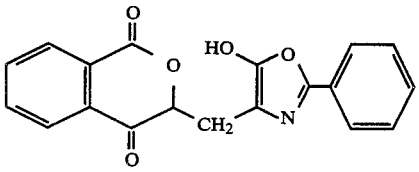
III-12
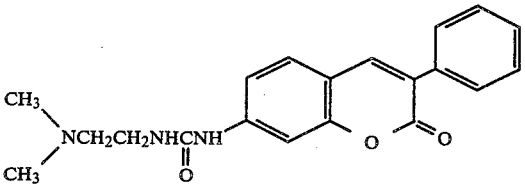
III-13
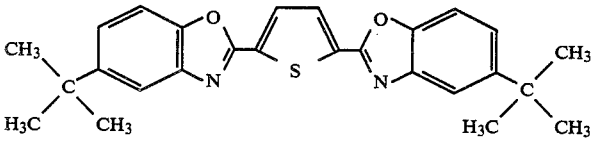
III-14
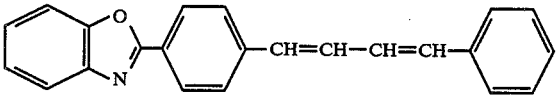
III-15
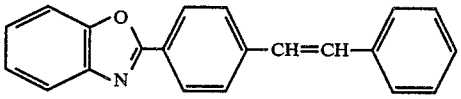
III-16
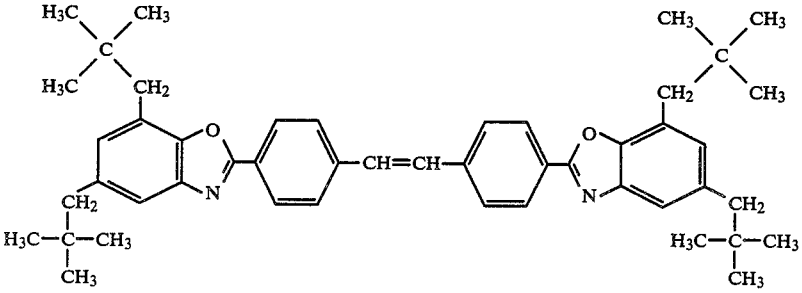
III-17
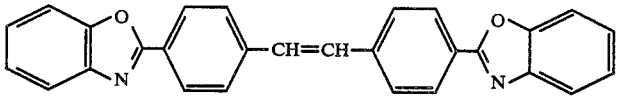

-continued

III-18

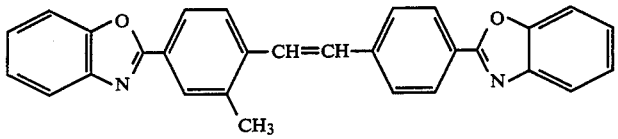

III-19

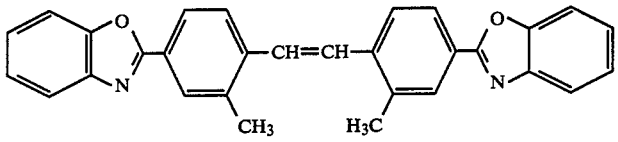

III-20

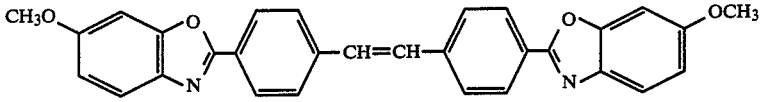

III-21

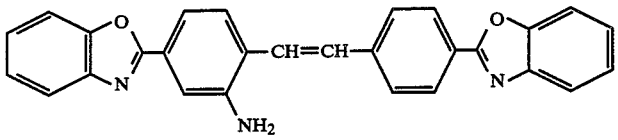

III-22

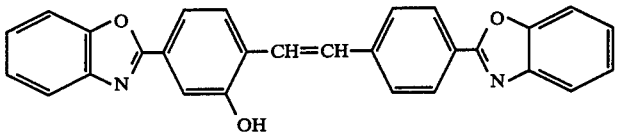

III-23

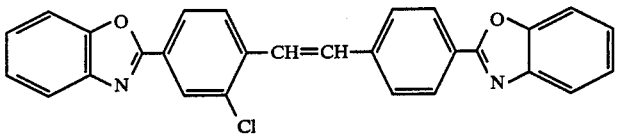

III-24

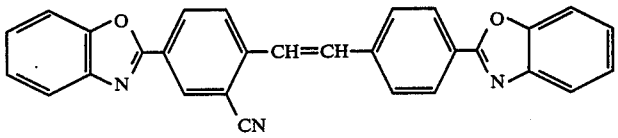

III-25

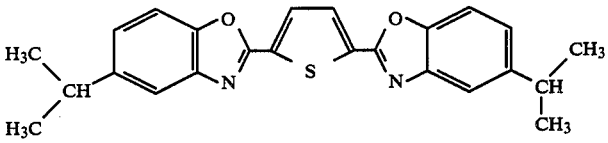

III-26

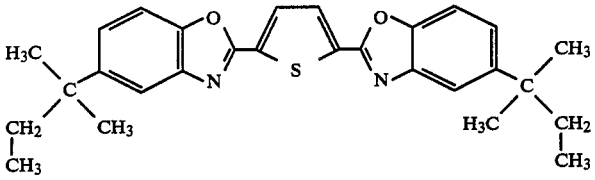

The amount of the brightening agent used is preferably from 1 to 200 mg per square meter of the finished printing paper, with the range of from 5 to 50 mg/m$^2$ being most preferred.

A brightening agent dispersion can be added to any layer of the photographic layer on the support. From a viewpoint of preventing blloming, the dispersion can be added to a silver halide emulsion layer or layers nearer to the support (hydrophilic colloidal layers such as an intermediate layer) than the silver halide emulsim layer.

Silver halide developing agents which can be used in the present invention are development activators capable of developing silver halide in an alkaline solution, for example, and include silver halide developing agents and precursors thereof. Representative examples of these silver halide developing agents are shown below.

Substituted or unsubstituted dihydroxybenzene compounds such as hydroquinone, 2-methylhydroquinone, 2,5-dimethylhydroquinone, trimethylhydroquinone, 2-chlorohydroquinone, 2-phenylhydroquinone, 2-tert-butylhydroquinone, catechol, and 4-tert-butylcatechol, polyhydric phenol compounds such as pyrogallol, 3-pyrazolidone compounds such as 1-phenyl-3-pyrazolidone, 1-(m-tolyl)-3-pyrazolidone, 1-phenyl-2-acetyl-3-pyrazolidone, 1-phenyl-4-methyl-3-pyrazolidone, 1-phenyl-4,4-dimethyl-3-pyraz-lidone, 1-phenyl-4-methyl-4-hydroxymethyl-3-pyrazolidone, 1-p-chlorophenyl-4-methyl-4-hydroxy-3-pyrazolidone, 1-(p-tolyl)-4,4-dihydroxymethyl-3-pyrazolidone, and 1-phenyl-4-hydroxymethyl-3-pyrazolidone, aminophenol compounds such as p-aminophenol, 2-amino-4-methylphenol, metol, and 4-hydroxyphenylaminoacetic acid, 4-aminoaniline compounds such as p-phenylenediamine, 4-(N,N-diethyl)aminoaniline, 4-(N-ethyl-N-hydroxyethyl) aminoaniline, 4-(N-ethyl-N$\beta$-methylsulfonaminoethyl)amino-2-methylaniline, 4-(N-ethyl-N-hydroxyethyl)amino-2-methylaniline, and their salts such as hydrochloric acid salts, sulfuric acid salts, p-toluenesulfonic acid salts, and tetraphenylphoronic acid salts, aminohexose reductone compounds, naphthalene diol, aminonaphthalene diol, and hydrazine.

Representative examples of developing agent precursors include 4-chloroacetyloxyhydroquinone, 1,4-diacetyloxyhydroquinone, catechol monobenzoate, 2-methylhydroquinone monoacetate, hydroquinone monobenzoate, 2-methoxyhydroquinone monobenzoate, hydroquinone monoacetate, and 1,4-dichloroacetyloxyhydroquinone.

The silver halide developing agents and their precurors are hereafter collectively referred to as "silver halide developing agents".

Silver halide developing agents can be used singly or in combination with each other. It is useful to use hydroquinone compounds in combination with 3-pyrazolidone compounds. The amount of the silver halide developing agent added is not critical and varies depending on the type of the silver halide developing agent, the type and use of the silver halide photographic printing paper, the type of silver in the silver halide emulsion, the properties of the emulsion, the effects of other additives, and so forth It is usually 5 g/m$^2$ or less and preferably from 1 to 0.01 g/m$^2$. In the case of hydroquinone compounds, it is preferably 3 g/m$^2$ or less and more preferably from 1 to 0.01 g/m$^2$, and in the case of 3-pyrazolidone compounds, it is preferably 1 g/m$^2$ or less and more preferably from 0.2 to 0.01 g/m$^2$.

The silver halide developing agents are desirably used in combination with antioxidizing agents for the purpose of increasing stability with time. Useful examples of such antioxidizing agent are benzenesulfinic acid and its derivatives, inorganic sulfurous acid salts, and formalin adducts. The amount of antioxidizing agents is generally from 0.01 to 10 mol per mol of the developing agent.

The silver halide developing agents and antioxidizing agents to be used in combination therewith can be added to any layer of the photographic layer, and generally added to a silver halide emulsion layer and other hydrophilic colloidal layers such as an intermediate layer or a protective layer.

As a binder or protective colloid for use in the emulsion layer and other hydrophilic colloidal layers, gelatin is preferably used. In addition, other hydrophilic colloids can also be used. For example, proteins such as gelatin derivatives, graft polymers of gelatin and other polymers, albumin, and casein, sugar derivatives such as cellulose derivatives (e.g., hydroxyethyl cellulose, carboxymethyl cellulose, and cellulose sulfate), sodium alginate, and starch derivatives, and a wide variety of synthetic hydrophilic polymers (homopolymers or copolymers) such as polyvinyl alcohol, polyvinyl alcohol partial acetal, poly(N-vinyl) pyrrolidone, polyacrylic acid, polymethacrylic acid, polyacrylamide, polyvinyl imidazole, and polyvinyl pyrazole can be used.

As gelatins, lime-processed gelatin, acid processed gelatin and enzyme-processed gelatin as described in *Bull.Soc. Sci. Phot. Japan,* No. 16, page 30 (1966) can be used. In addition, hydrolyzates and enzyme decomposition products of gelatin can be used.

The silver halide used in the photographic emulsion layer may be any of silver bromide, silver iodobromide, silver iodochlorobromide, silver chlorobromide, and silver chloride. A preferred example of a silver halide is silver iodobromide containing 15 mol% or less of silver iodide, with being particular preferred silver iodobromide containing from 1 to 12 mol% of silver iodide.

The mean grain size of silver halide grains in the photographic emulsion is not critical but is preferably 3 $\mu$m or less. This mean grain size is determined based on projected areas using grain diameter for spherial or nearly spherical grains or edge length for cubic grains as the grain size.

The grain size distribution may be narrow or broad.

The Silver halide grains may be made up of an inner portion (core) and a surface layer (shell) which are different in phase. Moreover, they may be grains in which a latent image is formed mainly on the surface thereof, or grains in which a latent image is formed mainly in the inside thereof.

Photographic emulsions that are used in the present invention can be prepared by the procedures described in P. Glafkides, *Chimie et Physique Photographique,* Paul Montel (1967), G. F. Duffin, *Photographic Emulsion Chemistry,* The Focal Press Co., Ltd. (1966), and V. L. Zelikman et al, *Making and Coating Photographic Emulsion,* The Focal Press Co., Ltd. (1964). That is, any of the acid process, the neutral process, the ammonia process, and so forth can be employed, and soluble silver salts and soluble halides can be reacted by any of the single-jet method, the double-jet method, a mixture thereof, and so forth.

A method (reverse mixing method) in which grains are formed under conditions where silver ions are in excess can be employed. As a modification of the double-jet method, a method in which the pAg in the liquid phase where silver halide is formed is kept constant, i.e., the controlled double jet method, can also be used. In accordance with the controlled double jet method, a silver halide emulsion can be obtained in which silver halide grains have a regular crystal shape and their grain sizes are nearly uniform.

Two or more silver halide emulsions which have been prepared independently may be mixed and used.

In the course of the formation of silver halide grains or physical ripening, cadmium salts, zinc salts, lead salts, thallium salts, iridium salts or complex salts thereof, rhodium salts or complex salts thereof, iron salts or complex salts thereof, etc. may be present in combination.

The silver halide emulsion is usually chemically sensitized. For this chemical sensitization, the procedures described in H. Frieser ed., *Die Grundlagender Photographischen Prozesse mit Silber-Halogeniden,* Akademische Verlagsgesellschaft, pp. 675–734 (1968), for example, can be used.

That is, a sulfur sensitization using sulfur-containing compounds capable of reacting with active gelatin and silver (e.g., thiosulfates, thioureas, mercapto compounds, and rhodanines), a reduction sensitization using reducing substances (e.g., stannous salts, amines, hydrazine derivatives, formamizinesulfinic acid, and silane compounds), a noble metal sensitization using noble metals (e.g., gold complex salts, and complex salts of Group VIII metals (e.g., Pt, Ir, and Pd of the Periodic Table), and so forth can be applied singly or in combination with each other.

In photographic emulsions that are used in the present invention there can be added various compound for the purpose of preventing fog during production, storage or photographic processing of the printing paper, or of stabilizing photographic performance. That is, a number of compounds known as antifoggants or stabilizers, such as azoles (e.g., benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (in particular, 1-phenyl-5-mercaptotetrazoles); mercaptopyrimidines; mercaptotriazines; keto compounds such as oxazolinethiones; azaindenes such as triazaindenes, tetrazaindenes (in particular, 4-hydroxy-substituted (1,3,3a,7)tetrazaindenes), and pentazaindenes; benzenethiosulfonic acid; benzenesulfinic acid; and benzenesulfonic acid amide can be added.

Representative examples of such compounds and methods of using them are described in U.S. Pat. Nos. 3,954,474, 3,982,947, and Japanese Patent Publication No. 28660/77, for example.

The photographic emulsion layer or other hydrophilic colloidal layers of the printing paper of the present invention may contain verious surface active agents for various purposes; for example, as auxiliary coating agents, or for prevention of charging, improvement of sliding properties, acceleration of emulsification or dispersion, prevention of adhesion, or improvement of photographic characteristics (e.g., acceleration of development, increasing contrast, and sensitization).

For example, the following can be used.

Nonionic surface active agents such as saponin (steroid-type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, and silicone/polyethylene oxide adducts), glycidol derivatives (e.g., alkenylsuccinic acid polyglycerides and alkylphenol polyglycerides), fatty acid esters of polyhydric alcohols, and alkyl esters of sugar, anionic surface active agents containing acidic groups such as a carboxyl group, a sulfo group, a phospho group, a sulfate group, and a phosphate group, such as alkylcarboxylic acid salts, alkylsulfonic acid salts, alkylbenzenesulfonic acid salts, alkylnaphthalenesulfonic acid salts, alkylsulfuric acid esters, alkyphosphoric acid esters, N-acyl-N-alkyltaurines, sulfosuccinic acid esters, sulfoalkylpolyoxyethylene alkylphenyl ethers, and polyoxyethylene alkylphosphoric acid esters, amphoionic surface active agents such as amino acids, aminoalkylsulfonic acids, aminoalkylsulfuric acid or phosphoric acid esters, alkylbetaines, and amine oxides, and cationic surface active agents such as alkylamine salts, aliphatic or aromatic quaternary ammonium salts, heterocyclic quaternary ammonium salts (e.g., phyridinium and imidazolium), and phosphonium or sulfonium salts containing an aliphatic or heterocyclic ring.

The photographic emulsion layer of the printing paper of the present invention may contain polyalkylene oxide or its derivatives (e.g., ethers, esters, and amines), thioether compounds, thiomorpholines, quaternary ammonium salt compounds, urethane derivatives, urea derivatives, imidazole derivatives, and 3-pyrazolidones for the purpose of increasing sensitivity, increasing contrast, or accelerating development.

In the photographic emulsion layer and other hydrophilic colloidal layers of the printing paper of the present invention there can be incorporated dispersions of water-insoluble or sparingly water-soluble synthetic polymers for the purpose of improving dimensional stability, for example. For example, homo- and copolymers of alkyl acrylates or methacrylates, alkoxyalkyl acrylates or methacrylates, glycidyl acrylates or methacrylates, acrylamides or methacrylamide, vinyl esters (e.g., vinyl acetate), acrylonitrile, olefins, and styrene, and copolymers of the above monomers and comonomers such as acrylic acid, methacrylic acid, $\alpha$, $\beta$-unsaturated dicarboxylic acids, hydroxyalkyl acrylates or methacrylates, sulfoalkyl acrylates or methacrylates, and styrenesulfonic acid can be used.

Photographic emulsions that are used in the present invention may be subjected to spectral sensitization with methine dyes, for example. Dyes which can be used for this purpose include cyanine dyes, merocyanine dyes, composite cyanine dyes, composite merocyanine dyes, holo-polar cyanine dyes, hemicyanine dyes, styryl dyes, and hemioxonol dyes. Particularly useful are cyanine dyes, merocyanine dyes, and composite merocyanine dyes. In these dyes, as basic heterocyclic ring nuclei, any nuclei commonly utilized in cyanine dyes can be applied. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; nuclei resulting from the fusion of alicyclic hydrocarbon rings to the above nuclei; nuclei resulting from the fusion of aromatic hydrocarbon rings to the above nuclei, i.e., an indolenine nucleus, a benzindolenine nucleus, an indole nucleus, a benzoxazole nucleus, a naphthoxazole nucleus, a benzothiazole nucleus, a naphtothiazole nucleus, a benzoselenazole nucleus, a benzimidazole nucleus, a quinoline nucleus, etc; and the like can be used. These nuclei may also be substituted at a carbon atom thereof if desired.

For merocyanine dyes or composite merocyanine dyes, as nuclei having a ketomethylene structure, 5- or 6-membered heterocyclic nuclei such as a pyrazoline-5-one nucleus, a thiohydantoin nucleus, a 2-thiooxazolidine-2,4-dione nucleus, a thiazolidine-2,4-dione nucleus, a rhodanine nucleus, and a thiovarbituric acid nucleus can be used.

The present invention can be applied to multi-layer, multi-color photographic materials having at least two different spectral sensitivities on a support. These multi-layer, natural-color photographic materials usually comprise a support and at least one red-sensitive emulsion layer, at least one green-sensitive emulsion layer, and at least one blue-sensitive emulsion layer. The order in which the above layers are provided on the support is not critical and can be determined appropriately. Usually, the red-sensitive emulsion layer contains cyan-forming couplers; the green-sensitive emulsion layer, magenta-forming couplers; and the blue-sensitive emulsion layer, yellow-forming couplers. In some cases, different combinations may be employed.

In the photographic emulsion layer of the printing paper of the present invention, dye-forming couplers, i.e., compounds capable of forming color upon oxidative coupling with aromatic primary amine developers (e.g., phenylenediamine derivatives and aminophenol derivatives) in color development may be used in combination. Magenta couplers include a 5-pyrazolone coupler, a pyrazolobezimidazole coupler, a cyanoacetylcumarone coupler, a closed-chain acylacetonitrile coupler, and the like. Yellow couplers include an acylacetamide coupler (e.g., benzoylacetanilides and pivaloylacetanilides). Cyan couplers include a naphthol coupler, a phenol coupler, and the like. These couplers are desirably non-diffusing ones containing a hydrophobic group called a ballast group in the molecule thereof, or are polymerized couplers. They may be 4-equivalent or 2-equivalent based on silver ions. In addition, colored couplers having the effect of color correction, or DIR couplers or DAR couplers releasing a development inhibitor or development accelerator upon development can be used.

The printing paper of the present invention may contain inorganic or organic hardening agents in the photographic emulsion layers or other hydrophilic colloidal layers. For example, chromium salts (e.g., chromium alum and chromium acetate), aldehydes (e.g., formaldehyde, glyoxal, and glutaraldehyde), N-methylol compounds (e.g., dimethylolurea, and methyloldimethylhydantoin), dioxane, derivatives (e.g., 2,3-dihydroxydioxane), active vinyl compounds (e.g., 1,3,5-triacryloylhexahydro-s-triazine and 1,3-vinylsulfonyl-2-propanol), active halogen compounds (e.g., 2,4-dichloro-6-hydroxy-s-triazine), and mucohalogenic acids (e.g., mucochloric acid, and mucophenoxychloric acid) can be used singly or in combination with each other.

In the printing paper of the present invention, when dyes and ultraviolet absorbers, for example, are incorporated in the hydrophilic colloidal layer, they may be mordanted with cationic polymers, for example.

The printing paper of the present invention may contain, as anti-color foggants, hydroquinone derivatives, aminophenol derivatives, gallic acid derivatives, ascorbic acid derivatives, etc.

In the printing paper of the present invention, water-soluble dyes may be incorporated in the hydrophilic colloidal layer as filter dyes or for various purposes such as for the prevention of irradiation. Dyes which can be used for this purpose include oxonol dyes, hemioxonol dyes, cyaninene dyes, styryl dyes, merocyanine dyes, and azo dyes. Of these compounds, oxonol dyes, hemioxonol dyes, and merocyanine dyes are most useful.

In the printing paper of the present invention, known anti-fading agents can be used. Color image stabilizers can be used singly or in combination with each other. The above known anti-fading agents include hydroquinone derivatives, gallic acid derivatives, p-alkoxyphenols, p-oxyphenols, derivatives, and bisphenols.

Supports which can be used in the present invention include paper, paper coated with baryta, and paper coated with α-olefin polymers such as polyethylene. To these supports can be added titanium oxide and dyes etc., for example, for the purpose of increasing whiteness. It is preferred to use water-impermeable reflection supports.

In photographic processing of the printing paper of the present invention, any known procedures can be used and known processing solutions can be employed in this photographic processing. The processing temperature is usually chosen within the range of from 18° to 50° C. Lower temperatures than 18∞ C. or higher temperatures than 50° C. can also be used. Depending on the purpose, a black-and-white development to form silver images, or a color photographic processing comprising a development to form dye images can be used.

Developers for use in the black-and-white photographic processing can contain known developing agents. As these developing agents, dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolidones, ascorbic acid, heterocyclic compounds resulting from condensation of a 1,2,3,4-tetrahydroquinone ring and an indolenine ring as described in U.S. Pat. No. 4,067,872, and the like, can be used singly or in combination with each other. The developer generally further contains known additives such as preservatives, alkali agents, pH buffers, and antifoggants and, if necessary, may containing auxiliary dissolving agents, color controlling agents, development accelerators, surface active agents, deforming agents, hard water softening agents, hardening agents, tackifiers, etc.

Fixers having a composition commonly used can be used. Fixing agents which can be used include, as well as thiosulfuric acid salts and thiocyanic acid salts, organic sulfur compounds known to be effective as fixing agents. The fixer may contain water-soluble aluminum salts as hardening agents.

The printing paper of the present invention is preferably processed by the use of an automatic developing machine, so that the rapid processing (processing time (dry to dry): 2 minutes or less) can be applied. It is preferred for the photographic processing to be carried out under the following conditions.

| | Temperature | Time |
|---|---|---|
| Development | 30–45 (°C.) | 5–60 seconds |
| Fixing | 30–45 (°C.) | 5–30 seconds |
| Water-washing | 30–45 (°C.) | 5–30 seconds |

In this case, as a fixing bath, it is preferred to use an acidic hardening-fixing bath containing polyvalent metals such as aluminum.

The present invention is described in greater detail with reference to the following non-limiting examples. Unless otherwise indicated, all percentages are by weight.

EXAMPLE 1

Preparation of Dispersion of Brightening Agent

An oil-soluble brightening agent (8 g) having the following formula:

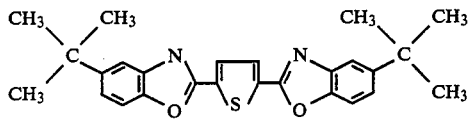

was dissolved in a mixture of 100 ml of a high boiling point organic solvent as shown in Table 1 and 200 ml of ethyl acetate, mixed at about 60° C. with 800 ml of a 12% aqueous gelatin solution containing 7 g (calculated as solids) of dodecylbenzenesulfonic acid, and then vigorously stirred in a homogenizer to prepare a emulsified dispersion.

Preparation of Coating Solution for Emulsion Layer

Fifty grams of a silver iodobromide emulsion (mean grain size: 0.6 μm; crystal shape: cubic; iodine content: 1.2 mol%; gelatin concentration: 6%; corresponding to 8.5 g of silver nitrate) which had been subjected to gold and sulfur sensitization so that the optimum sensitivity was obtained was mixed with 140 ml of a 3% aqueous gelatin solution. To this mixture were added 6 ml of a 0.1% methanol solution of a sensitizing dye having the following formula:

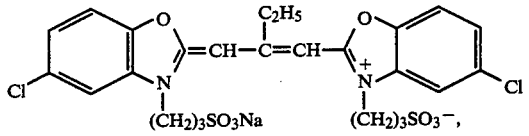

1.0 ml of a 0.1% methanol solution of 1-phenyl-5-mercaptotetrazole, 0.6 g of hydroquinone, and 30 g of the above-prepared dispersion of the brightening agent to prepare a coating solution for preparation of an emulsion layer (hereinafter referred to as an "emulsion layer coating solution")

Preparation of Light-Sensitive Sample

To 100 ml of a 5.5% aqueous gelatin solution was added 5.5 ml of a 2% aqueous solution of a surface active agent, Triton X-200 (produced by Rhom & Haas Co.) to prepare a coating solution for preparation of a protective layer (hereinafter referred to as a "protective layer coating solution"). The emulsion layer coating solution and protective layer coating solution were coated in that order on a polyethylene-coated paper support in amounts of 50 ml/m$^2$, and 30 ml/m$^2$, respectively, to prepare a light-sensitive sample.

Measurement of Fluorescent Intensity and Whiteness

The above-prepared sample was processed with Developer A and Fixer B as described below without exposure.

The processing conditions were as follows.

| | Temperature | Time |
|---|---|---|
| Development | 35 (°C.) | 18 seconds |
| Fixing | 35 (°C.) | 15 seconds |
| Washing with Water | 15 (°C.) | 15 seconds |

-continued

| | Temperature | Time |
|---|---|---|
| Developer A | | |
| 1-Phenyl-3-phyrazolidone | 0.4 g | |
| Sodium sulfite | 67.0 g | |
| Hydroquinone | 23 g | |
| Potassium hydroxide | 11 g | |
| Sodium carbonate monohydrate | 11 g | |
| Potassium bromide | 3 g | |
| Water to make | 1000 ml | |
| Fixer B | | |
| Ammonium thiosulfate | 170 g | |
| Sodium sulfite (anhydrous) | 15 g | |
| Boric acid | 7 g | |
| Glacial acetic acid | 15 ml | |
| Potasium alum | 20 g | |
| Ethylenediaminetetraacetic acid | 0.1 g | |
| Tartaric acid | 3.5 g | |
| Water to make | 1000 ml | |

The fluorescent intensity was measured using excitation light having a wavelength of 400 nm by means of a spectral fluorescent photometer (Model 850 produced by Hitachi Seisaku Jo Co., Ltd.). Further, the whiteness was measured using excitation light having a wavelength of 400 nm from a xenon lamp as a light source (band width: 5 mm) by means of Elrefo whiteness meter produced by Karl Zeiss Co., Ltd. The results are shown in Table 2.

For comparison, the same procedure as above was repeated with the exception that hydroquinone was not added in the preparation of an emulsion layer coating solution. The results are also shown in Table 2.

TABLE 2

| Sample No. | Type of Organic Solvent | Specific Inductive Capacity | Relative Flourescent Intensity after Processing: Not containing Hydroquinone | Relative Flourescent Intensity after Processing: Containing Hydroquinone | Whiteness Containing Hydroquinone |
|---|---|---|---|---|---|
| 1 | 1-a | 4.17 | 1.00 | 0.98 | 95% |
| 2 | 1-b | 4.41 | 0.95 | 0.94 | 94 |
| 3 | 1-c | 4.80 | 0.95 | 0.94 | 95 |
| 4 | 1-d | 4.89 | 0.95 | 0.94 | 95 |
| 5 | 1-e | 5.15 | 0.97 | 0.95 | 95 |
| 6 | 1-f | 5.78 | 0.94 | 0.93 | 94 |
| 7 | 1-g | 6.45 | 0.96 | 0.83 | 91 |
| 8 | 1-h | 6.74 | 0.95 | 0.89 | 92 |
| 9 | 1-i | 7.35 | 0.94 | 0.85 | 90 |
| 10 | 2-a | 7.53 | 0.97 | 0.63 | 84 |
| 11 | 2-b | 8.30 | 0.94 | 0.64 | 84 |
| 12 | 2-c | 13.45 | 0.96 | 0.52 | 81 |

It can be seen from Table 2 that in Sample Nos. 1 to 9 (examples of the present invention), the fluorescent intensity is high and the whiteness is good even when hydroquinone is present, as compared with Sample Nos. 10 to 12 (comparative examples).

EXAMPLE 2

The procedure of Example 1 was repeated but the oil-soluble brightening agent was replaced by a compound having the following formula:

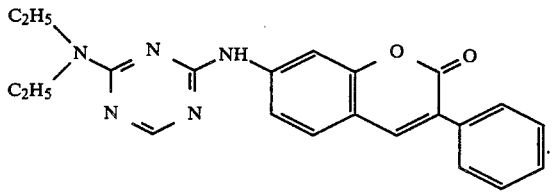

The results are shown in Table 3.

It can be seen from Table 3 that in Sample Nos. 13 to 21 (examples of the present invention), good results were obtained as in Example 1.

TABLE 3

| Sample No. | Type of Organic Solvent | Relative Fluorescent Intensity after Processing: Not containing Hydroquinone | Relative Fluorescent Intensity after Processing: Containing Hydroquinone | Whiteness Containing Hydroquinone |
|---|---|---|---|---|
| 13 | 1-a | 1.00 | 0.99 | 94% |
| 14 | 1-b | 0.97 | 0.96 | 93 |
| 15 | 1-c | 0.98 | 0.96 | 94 |
| 16 | 1-d | 0.96 | 0.96 | 94 |
| 17 | 1-e | 0.98 | 0.97 | 94 |
| 18 | 1-f | 0.97 | 0.95 | 93 |
| 19 | 1-g | 0.98 | 0.86 | 90 |
| 20 | 1-h | 0.97 | 0.91 | 91 |
| 21 | 1-i | 0.96 | 0.88 | 88 |
| 22 | 2-a | 0.98 | 0.65 | 82 |
| 23 | 2-b | 0.96 | 0.68 | 82 |
| 24 | 2-c | 0.98 | 0.58 | 80 |

EXAMPLE 3

The procedure of Example 1 was repeated wherein 0.5 g of hydroquinone was added not to the emulsion layer coating solution but was added to the protective layer coating solution. The same results as in Example 1 were obtained.

EXAMPLE 4

The procedure of Example 1 was repeated wherein 0.9 ml of a 10% methanol solution of 1-phenyl-4-methyl-4-hydroxymethyl-3-pyrazolidone was further added to the emulsion layer coating solution. The same results as in Example 1 were obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic printing paper comprising a support having on the support a photographic layer, containing a photographic emulsions and a silver halide developing agent, wherein an emulsified dispersion of an oil-soluble brightening agent in a high boiling point organic solvent having a specific inductive capacity of 7.5 or less is contained in the photographic layer.

2. A silver halide photographic printing paper as claimed in claim 1, wherein the high boiling point organic solvent has a specific inductive capacity of 6.0 or less.

3. A silver halide photographic printing paper as claimed in claim 1, wherein the specific inductive capacity is 2.0 or more.

4. A silver halide photographic printing paper as claimed in claim 1, wherein the high boiling point organic solvent is selected from the group consisting of carboxylic acid esters, phosphoric acid esters, carboxylic acid amides, and substituted hydrocarbons.

5. A silver halide photographic printing paper as claimed in claim 2, wherein the high boiling point organic solvent is selected from group consisting of carboxylic acid esters, phoshoric acid esters, carboxylic acid amides, and substituted hydrocarbons.

6. A silver halide photographic printing paper as claimed in claim 1, wherein the high boiling point organic solvent has a boiling point of 150° C. or higher.

7. A silver halide photographic printing paper as claimed in claim 6, wherein the high boiling point organic solvent has a boiling point of 200° C. or higher.

8. A silver halide photographic printing paper as claimed in claim 1, wherein the high boiling point organic solvent is selected from the group consisting of

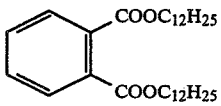

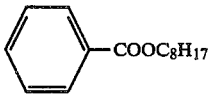

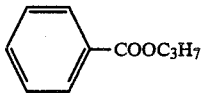

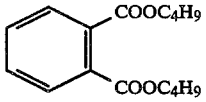

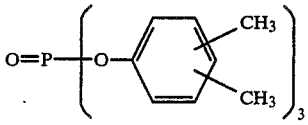

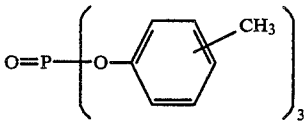

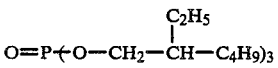

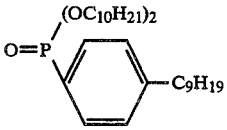

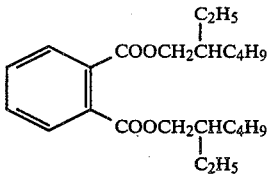

9. A silver halide photographic printing paper as claimed in claim 1, wherein the brightening agent is contained in an amount of from 1 to 200 mg/m$^2$.

10. A silver halide photographic printing paper as claimed in claim 9, wherein the brightening agent is contained in an amount of from 5 to 50 mg/m$^2$.

11. A silver halide photographic printing paper as claimed in claim 1, wherein the weight ratio of the high boiling point organic solvent to the brightening agent is from 100/0.1 to 100/50.

12. A silver halide photographic printing paper as claimed in claim 1, wherein the silver halide developing agent added is contained in an amount of 5 g/m$^2$ or less.

13. A silver halide photographic printing paper as claimed in claim 12, wherein the silver halide developing agent is contained in an amount of from 1 to 0.01 g/m$^2$.

* * * * *